US011049478B2

(12) United States Patent
Zheng

(10) Patent No.: US 11,049,478 B2
(45) Date of Patent: Jun. 29, 2021

(54) DISPLAY DRIVING SYSTEM

(71) Applicant: Shenzhen China Star Optoelectronics Technology Co., Ltd., Shenzhen (CN)

(72) Inventor: Yanxuan Zheng, Shenzhen (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 353 days.

(21) Appl. No.: 16/308,481

(22) PCT Filed: Sep. 20, 2018

(86) PCT No.: PCT/CN2018/106609
§ 371 (c)(1),
(2) Date: Dec. 10, 2018

(87) PCT Pub. No.: WO2019/227785
PCT Pub. Date: Dec. 5, 2019

(65) Prior Publication Data

US 2021/0090528 A1 Mar. 25, 2021

(30) Foreign Application Priority Data

May 31, 2018 (CN) ..... 201810552033.5

(51) Int. Cl.
*G09G 3/36* (2006.01)
*G09G 5/397* (2006.01)

(52) U.S. Cl.
CPC ..... *G09G 5/397* (2013.01); *G09G 3/3611* (2013.01); *G09G 2310/08* (2013.01);
(Continued)

(58) Field of Classification Search
None
See application file for complete search history.

(56) References Cited

U.S. PATENT DOCUMENTS

2007/0222774 A1* 9/2007 Foster ..... G06F 3/1431 345/204
2010/0302214 A1* 12/2010 Kim ..... G09G 3/20 345/204

(Continued)

FOREIGN PATENT DOCUMENTS

CN 1734539 A 2/2006
CN 105245759 A 1/2016

(Continued)

*Primary Examiner* — Bryan Earles
(74) *Attorney, Agent, or Firm* — Leong C. Lei

(57) ABSTRACT

The invention provides a display driving system having a master chip and a plurality of slave chips. The master chip marks a serial number of the storage unit buffering the display data of the corresponding region of an image frame in the N storage units when using the connected memory to buffer the display data of the corresponding region; when reading the display data of the corresponding region stored in a storage unit, marks the serial number of the read storage unit, generating a corresponding synchronization signal to transmit to each slave chip to control the display data of an image frame to be buffered synchronously to storage units of the same serial number in the plurality of memories, and control the master/slave chips to synchronously read respectively the display data of the image frame from the storage units with the same serial number in the connected memory.

9 Claims, 3 Drawing Sheets

(52) U.S. Cl.
CPC ..... *G09G 2360/12* (2013.01); *G09G 2360/18* (2013.01); *G09G 2370/00* (2013.01)

(56) References Cited

U.S. PATENT DOCUMENTS

| | | | | |
|---|---|---|---|---|
| 2012/0086681 | A1 | 4/2012 | Kim et al. | |
| 2017/0263204 | A1* | 9/2017 | Tanaka | G09G 3/3677 |

FOREIGN PATENT DOCUMENTS

| | | | |
|---|---|---|---|
| CN | 105549933 | A | 5/2016 |
| CN | 106716519 | A | 5/2017 |

* cited by examiner

DISPLAY DRIVING SYSTEM

BACKGROUND OF THE INVENTION

1. Field of the Invention

The present invention relates to the field of display, and in particular to a display driving system.

2. The Related Arts

In the field of display technology, the panel display device, such as, liquid crystal display (LCD), has gradually replaced a cathode ray tube (CRT) display device. The LCD device has many advantages, such as, thinness, power saving, no radiation, and so on, and has been widely used.

Most of the LCDs on the market are backlight type LCD, which comprises an LCD panel and a backlight module. Generally, an LCD panel comprises a color filter (CF) substrate, a thin film transistor (TFT) array substrate, a liquid crystal (LC) layer sandwiched between the CF substrate and the TFT array substrate, and a sealant. The operating principle of the LCD panel is to place LC molecules in two parallel glass substrates, with many vertical and horizontal thin wires between the two glass substrates, and the LC molecules are controlled to change direction by energizing the wires or not to refract the light of the backlight module to produce an image.

In the prior art, the display data needs to be processed by a field programmable gate array (FPGA) chip for image processing and then output to the display to drive the display. The usual method is to use the FPGA chip to cache several frames of display data in the memory. In the body, the FPGA chip reads and converts the data buffered in the memory for output. With the continuous development of video display technology, high-resolution and high refresh rate designs are becoming more and more popular. High resolution and high refresh rate require higher storage bandwidth and higher speed, higher channel high-speed transmission interface. In actual design, the storage bandwidth and the number of transmission interfaces of an FPGA chip are limited, which means that only providing one FPGA chip cannot meet the high resolution and high refresh rate design. Therefore, two or more FPGA chips must be disposed. Generally, a frame is divided into multiple regions, and multiple regions are respectively corresponding to multiple FPGA chips. A plurality of memories are disposed corresponding to the plurality of FPGA chips, and each of the FPGA chips stores the display data of the corresponding region of the plurality of image frames in the corresponding memory, and then reads the data in the corresponding memory and converts the data for output. This design can be adapted to high resolution and high refresh rate design but does not guarantee that the data output by each FPGA belongs to the same frame, which causes the abnormal display of the image.

SUMMARY OF THE INVENTION

The object of the present invention is to provide a display driving system, able to use a plurality of chips to convert the display data and eliminate the abnormal display of images caused by asynchronization among the plurality of chips.

To achieve the above object, the present invention provides a display driving system, which comprises: M chips, M memories, an input end and a display, wherein M being a positive integer greater than 2;

the input end being electrically connected to the M chips; the display being electrically connected to the M chips; each memory being electrically connected to a chip; each memory comprising N storage units arranged in sequence, wherein N being a positive integer greater than 1; one of the M chips being defined as a master chip, and the rest being defined as a slave chip, each slave chip being electrically connected to the master chip;

the input end receiving display data of a plurality of image frames, each image frame comprising M regions, each region corresponding to a chip; the input end respectively transmitting display data of corresponding regions of the plurality of image frames to the M chips; the chip sequentially loop buffering the display data of the corresponding region of the plurality of image frames into the N storage units of the memory connected thereto, and sequentially loop reading and converting the display data of the corresponding region of the plurality of image frames stored in the N storage units, and transmitting to the display;

the master chip marking a serial number of the storage unit buffering the display data of the corresponding region of an image frame in the N storage units when using the connected memory thereto to buffer the display data of the corresponding region of the image frame; when reading the display data of the corresponding region of an image frame stored in a storage unit of the memory, marking the serial number of the read storage unit in the N storage units, generating a corresponding synchronization signal and transmitting to each slave chip to control the display data of the M regions of an image frame to be buffered synchronously to storage units of the same serial number in the M memories, and controlling the master chip and the slave chips to synchronously read respectively the display data of corresponding region of a stored image frame from the storage units with the same serial number in the memory connected thereto.

Wherein, M=2.

Wherein, each image frame comprises M regions sequentially arranged in a horizontal direction.

Wherein, each image frame comprises M regions sequentially arranged in a vertical direction.

Wherein, the M regions have the same area size.

Wherein, the M chips are all FPGA chips.

Wherein, N=4.

Wherein, the input end receives the display data of the plurality of image frames and also receives an input frame start signal of the plurality of image frames, and the input end transmits the display data of the corresponding region of the plurality of image frames to the master chip and also the input frame start signal of the plurality of image frames to the master chip;

the master chip processes the input frame start signal of the plurality of image frames to generate an output frame start signal corresponding to the plurality of image frames;

the process of the master chip marking a serial number of the storage unit buffering the display data of the corresponding region of an image frame in the N storage units when using the connected memory thereto to buffer the display data of the corresponding region of the image frame; when reading the display data of the corresponding region of an image frame stored in a storage unit of the memory, marking the serial number of the read storage unit in the N storage units, generating a corresponding synchronization signal specifically comprises: at the rising edge of the input frame start signal of an image frame, the master chip uses the memory connected thereto to buffer the display data of the corresponding region of the image frame, and the master chip transmits to each slave chip a sequentially generated high pulse with a first default duration, A high pulses with a second default duration, and a low level with a third default duration, wherein A equals to the serial number of the storage unit buffering the display data of corresponding region of the image frame in the N storage units, and then at the rising edge of the output start signal of the other frame, the master chip reads from the storage unit of the memory connected thereto storing the display data of the corresponding region of the other image frame, and the master chip transmits to each slave chip a sequentially generated high pulse with a fourth default duration, B high pulses with the second default duration, and a low level with the third default duration, wherein B equals to the serial number of the storage unit buffering the display data of corresponding region of the other image frame in the N storage units.

Wherein, the master chip also transmits a pulse clock signal to each of the slave chips;

the first default duration is equal to 3 times the period of the pulse signal;

the second default duration is equal to the period of the pulse signal;

the third default duration is greater than or equal to 4 times the period of the pulse signal;

the fourth default duration is equal to 5 times the period of the pulse signal.

The present invention provides the following advantages: the display driving system of the present invention provides a master chip and a plurality of slave chips. The master chip marks a serial number of the storage unit buffering the display data of the corresponding region of an image frame in the N storage units when using the connected memory thereto to buffer the display data of the corresponding region of the image frame; when reading the display data of the corresponding region of an image frame stored in a storage unit of the memory, marks the serial number of the read storage unit in the N storage units, generating a corresponding synchronization signal to transmit to each slave chip to control the display data of an image frame to be buffered synchronously to storage units of the same serial number in the plurality of memories, and control the master chip and the slave chips to synchronously read respectively the display data of a stored image frame from the storage units with the same serial number in the memory connected thereto. As such, the present invention is advantageous to realize high resolution and high refresh rate designs and can eliminate the abnormal display of images caused by asynchronization among the plurality of chips.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
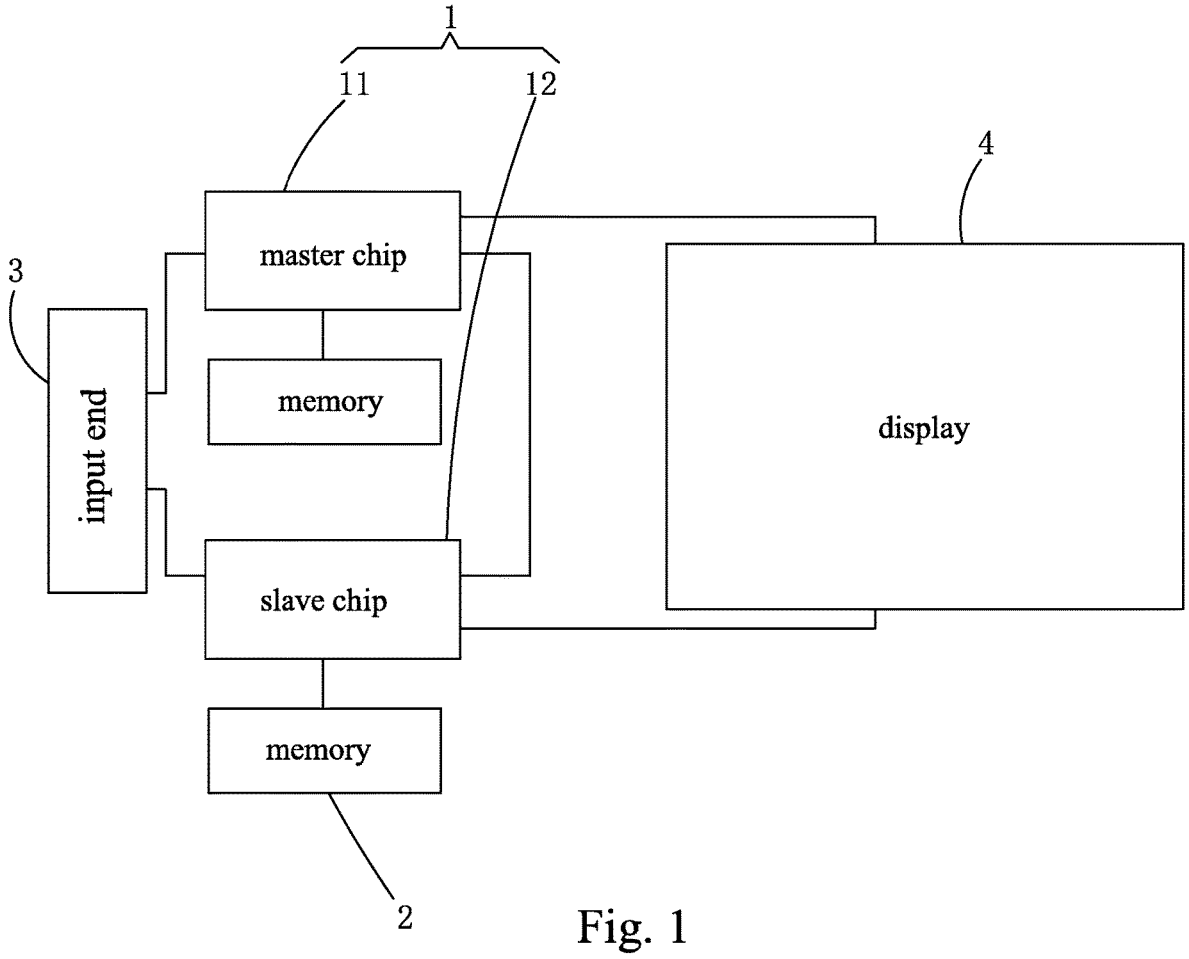
FIG. 1 is a schematic view showing the structure of the display driving system of the present invention.

Refer to FIG. 1. The present invention provides a display driving system, comprising: M chips 1, M memories 2, an input end 3 and a display 4, wherein M is a positive integer greater than 2.

The input end 3 is electrically connected to the M chips 1; the display 4 is electrically connected to the M chips 1. Each memory 2 is electrically connected to a chip 1; each memory 2 comprises N storage units 21 arranged in sequence, wherein N is a positive integer greater than 1. One of the M chips 1 is defined as a master chip 11, and the rest is defined as a slave chip 12, each slave chip 12 is electrically connected to the master chip 11.

The input end 3 receives display data of a plurality of image frames, each image frame comprises M regions, each region corresponds to a chip 1. The input end 3 respectively transmits the display data of corresponding regions of the plurality of image frames to the M chips 1. The chip 1 sequentially loop buffers the display data of the corresponding region of the plurality of image frames into the N storage units 21 of the memory 2 connected thereto, and sequentially loop reads and converts the display data of the corresponding region of the plurality of image frames stored in the N storage units 21, and transmits to the display 4.

The master chip 11 marks a serial number of the storage unit 21 buffering the display data of the corresponding region of an image frame in the N storage units 21 when using the connected memory 2 thereto to buffer the display data of the corresponding region of the image frame; when reading the display data of the corresponding region of an image frame stored in a storage unit 21 of the memory 2, marks the serial number of the read storage unit 21 in the N storage units 21, generates a corresponding synchronization signal and transmitting to each slave chip 12 to control the display data of the M regions of an image frame to be buffered synchronously to storage units 21 of the same serial number in the M memories 2, and controls the master chip 11 and the slave chips 12 to synchronously read respectively the display data of corresponding region of a stored image frame from the storage units 21 with the same serial number in the memory 2 connected thereto.

Specifically, each image frame comprises M regions sequentially arranged in a horizontal or a vertical direction.

Preferably, the M regions have the same area size.

Specifically, in the embodiment of FIG. 1, M=2. That is, on the embodiment of FIG. 1, the display driving system comprises two chips, wherein one is defined as the master chip 11 and the other as the salve chip 12. Correspondingly, each image frame comprises two regions, and the two regions correspond to the master chip 11 and the slave chip 12 respectively.

Specifically, the M chips 1 are all FPGA chips.

Figure 2:
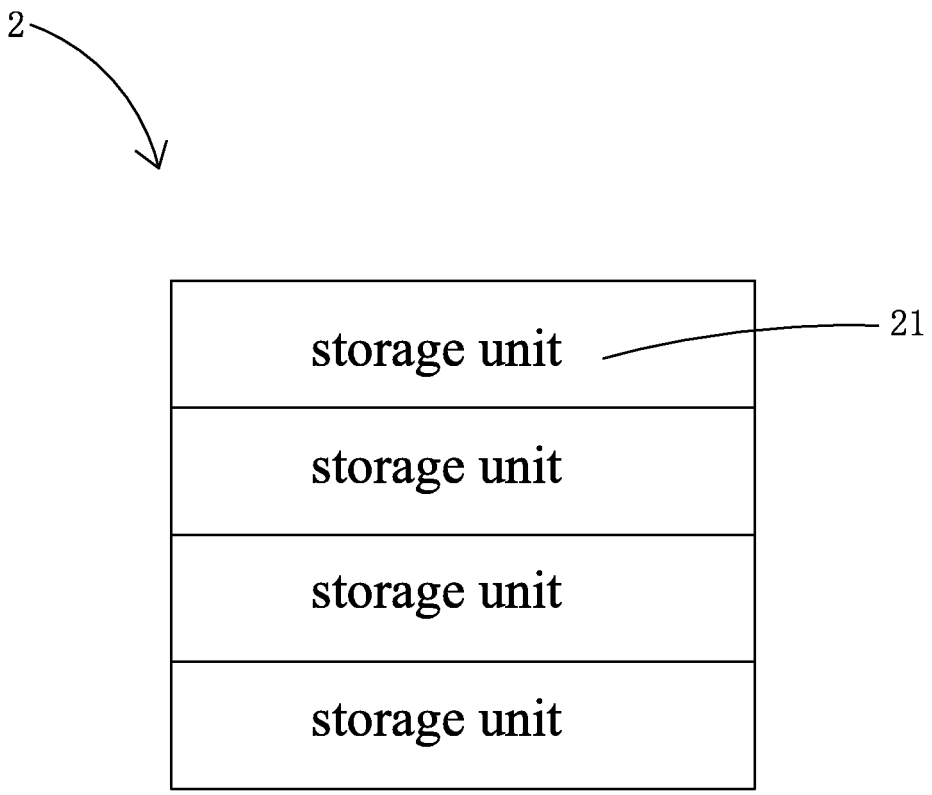
FIG. 2 is a schematic view showing the memory structure of the display driving system of the present invention.

Specifically, as shown in FIG. 2, in an preferred embodiment of the present invention, N=4. That is, each memory 2 comprises four storage units 21 arranged in sequence and can simultaneously store the display data of corresponding region of four image frames.

Specifically, the input end 3 receives the display data of the plurality of image frames and also receives an input frame start signal of the plurality of image frames, and the input end 3 transmits the display data of the corresponding region of the plurality of image frames to the master chip 11 and also the input frame start signal of the plurality of image frames to the master chip 11.

The master chip 11 processes the input frame start signal of the plurality of image frames to generate an output frame start signal corresponding to the plurality of image frames.

Figure 3:
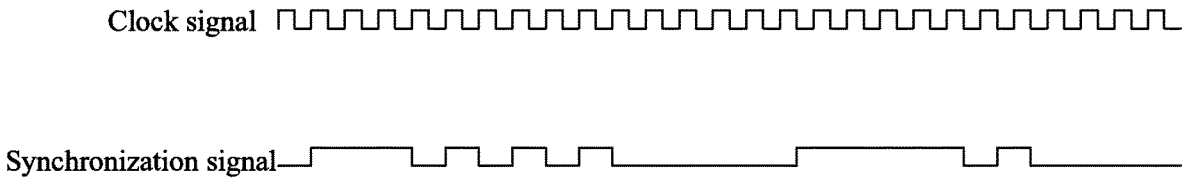
FIG. 3 is a schematic view showing the waveform of the synchronization signal and clock signal of the display driving system of the present invention.

Refer to FIG. 3. In a preferred embodiment of the present invention, the process of the master chip 11 marking a serial number of the storage unit 21 buffering the display data of the corresponding region of an image frame in the N storage units 21 when using the connected memory 2 thereto to buffer the display data of the corresponding region of the image frame; when reading the display data of the corresponding region of an image frame stored in a storage unit 21 of the memory 2, marking the serial number of the read storage unit 21 in the N storage units 21, generating a corresponding synchronization signal specifically comprises: at the rising edge of the input frame start signal of an image frame, the master chip 11 uses the memory 2 connected thereto to buffer the display data of the corresponding region of the image frame, and the master chip 11 transmits to each slave chip 12 a sequentially generated high pulse with a first default duration, A high pulses with a second default duration, and a low level with a third default duration, wherein A equals to the serial number of the storage unit 21 buffering the display data of corresponding region of the image frame in the N storage units 21. The high pulse with the first default duration indicates the rising edge of the input frame start signal of the image frame, and the A high pulses with the second default duration indicates that the serial number of the storage unit 21 buffering the display data of the corresponding region in the N storage units 21 is A. For example, as shown in FIG. 3, the serial number of the storage unit 21 that buffers the display data of the corresponding region of the image frame at this time in the N storage unit 21 is 3. The low level with the third default duration indicates the end of the transmission. Then, at the rising edge of the output start signal of the other frame, the master chip 11 reads from the storage unit 21 of the memory 2 connected thereto storing the display data of the corresponding region of the other image frame, and the master chip 11 transmits to each slave chip 12 a sequentially generated high pulse with a fourth default duration, B high pulses with the second default duration, and a low level with the third default duration, wherein B equals to the serial number of the storage unit 21 buffering the display data of corresponding region of the other image frame in the N storage units 21. The high pulse with the fourth default duration indicates that the rising edge of the output frame start signal of the other image frame picture arrives, and the B high pulses with the second default duration indicate that the serial number of the storage unit 21 buffering the display data of the corresponding region of the other image frame in the N storage units 21 is B. For example, as shown in FIG. 3, the serial number of the storage unit 21 that buffers the display data of the corresponding region of the other image frame at this time in the N storage unit 21 is 1. The low level with the third default duration indicates the end of the transmission.

Moreover, in a preferred embodiment of the present invention, the master chip 11 also transmits a pulse clock signal to each of the slave chips 12. Referring to FIG. 3, the first default duration is equal to 3 times the period of the pulse signal; the second default duration is equal to the period of the pulse signal; the third default duration is greater than or equal to 4 times the period of the pulse signal; the fourth default duration is equal to 5 times the period of the pulse signal.

It should be noted that the display driving system of the present invention provides a master chip 11 and a plurality of slave chips 12. The master chip 11 marks a serial number of the storage unit 21 buffering the display data of the corresponding region of an image frame in the N storage units 21 when using the connected memory 2 thereto to buffer the display data of the corresponding region of the image frame; when reading the display data of the corresponding region of an image frame stored in a storage unit 21 of the memory 2, marks the serial number of the read storage unit 21 in the N storage units 21, generating a corresponding synchronization signal to transmit to each slave chip 12 to control the display data of an image frame to be buffered synchronously to storage units 21 of the same serial number in the plurality of memories 2, and control the master chip 11 and the slave chips 12 to synchronously read respectively the display data of a stored image frame from the storage units 21 with the same serial number in the memory 2 connected thereto to achieve synchronous driving of the plurality of chips 1. As such, the present invention is advantageous to realize high resolution and high refresh rate designs and can eliminate the abnormal display of images caused by asynchronization among the plurality of chips 1. In addition, the design is simple as only one synchronization signal is needed.

In summary, the display driving system of the present invention provides a master chip and a plurality of slave chips. The master chip marks a serial number of the storage unit buffering the display data of the corresponding region of an image frame in the N storage units when using the connected memory thereto to buffer the display data of the corresponding region of the image frame; when reading the display data of the corresponding region of an image frame stored in a storage unit of the memory, marks the serial number of the read storage unit in the N storage units, generating a corresponding synchronization signal to transmit to each slave chip to control the display data of an image frame to be buffered synchronously to storage units of the same serial number in the plurality of memories, and control the master chip and the slave chips to synchronously read respectively the display data of a stored image frame from the storage units with the same serial number in the memory connected thereto. As such, the present invention is advantageous to realize high resolution and high refresh rate designs and can eliminate the abnormal display of images caused by asynchronization among the plurality of chips.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A display driving system, which comprises: M chips, M memories, an input end and a display, wherein M is a positive integer equal to or greater than 2;

the input end being electrically connected to the M chips;

the display being electrically connected to the M chips;

each memory being electrically connected to a chip;

each memory comprising N storage units arranged in sequence, wherein N is a positive integer greater than 1; one of the M chips being defined as a master chip, and the rest being defined as a slave chip, each slave chip being electrically connected to the master chip;

the input end receiving display data of a plurality of image frames, each image frame comprising M regions, each region corresponding to a chip; the input end respectively transmitting display data of corresponding regions of the plurality of image frames to the M chips; the chip sequentially loop buffering the display data of the corresponding region of the plurality of image frames into the N storage units of the memory connected thereto, and sequentially loop reading and converting the display data of the corresponding region of the plurality of image frames stored in the N storage units, and transmitting to the display;

wherein in buffering the display data of a corresponding region of an image frame in the memory connected thereto, the master chip marks a serial number of one of the storage units that buffers the display data of the corresponding region of the image frame; and in reading the display data of the corresponding region of an image frame stored in one of the storage units of the memory connected thereto, the master chip marks the serial number of the one of the storage units, and the master chip generating and transmitting a corresponding synchronization signal to each slave chip such that the display data of the M regions of the image frame are buffered synchronously to storage units of the M memories having the same serial number, and controlling the master chip and the slave chips to synchronously read respectively the display data of corresponding region of a stored image frame from the storage units with the same serial number in the memory connected thereto;

wherein the plurality of image frames are stored in the M memories, such that each of the M memories stores a corresponding one of the M regions of each of the plurality of image frames and each of the plurality of image frames is stored in the M memories by having the M regions thereof respectively buffered in the M memories, wherein the M regions of each of the plurality of image frames are stored in the storage units of the M memories having the same serial number and the M regions of one of the plurality of image frames are simultaneously readable from the storage units of the M memories having the same serial number.

2. The display driving system as claimed in claim 1, wherein M=2.

3. The display driving system as claimed in claim 1, wherein each image frame comprises M regions sequentially arranged in a horizontal direction.

4. The display driving system as claimed in claim 1, wherein each image frame comprises M regions sequentially arranged in a vertical direction.

5. The display driving system as claimed in claim 1, wherein the M regions have the same area size.

6. The display driving system as claimed in claim 1, wherein the M chips are all field programmable gate array (FPGA) chips.

7. The display driving system as claimed in claim 1, wherein N=4.

8. The display driving system as claimed in claim 1, wherein the input end receives the display data of the plurality of image frames and also receives an input frame start signal of the plurality of image frames, and the input end transmits the display data of the corresponding region of the plurality of image frames to the master chip and also the input frame start signal of the plurality of image frames to the master chip;

the master chip processes the input frame start signal of the plurality of image frames to generate an output frame start signal corresponding to the plurality of image frames;

the process of the master chip marking a serial number of the storage unit buffering the display data of the corresponding region of an image frame in the N storage units when using the connected memory thereto to buffer the display data of the corresponding region of the image frame; when reading the display data of the corresponding region of an image frame stored in a storage unit of the memory, marking the serial number of the read storage unit in the N storage units, generating a corresponding synchronization signal specifically comprises: at the rising edge of the input frame start signal of an image frame, the master chip uses the memory connected thereto to buffer the display data of the corresponding region of the image frame, and the master chip transmits to each slave chip a sequentially generated high pulse with a first default duration, A high pulses with a second default duration, and a low level with a third default duration, wherein A equals to the serial number of the storage unit buffering the display data of corresponding region of the image frame in the N storage units, and then at the rising edge of the output start signal of the other frame, the master chip reads from the storage unit of the memory connected thereto storing the display data of the corresponding region of the other image frame, and the master chip transmits to each slave chip a sequentially generated high pulse with a fourth default duration, B high pulses with the second default duration, and a low level with the third default duration, wherein B equals to the serial number of the storage unit buffering the display data of corresponding region of the other image frame in the N storage units.

9. The display driving system as claimed in claim 8, wherein the master chip also transmits a pulse clock signal to each of the slave chips;

the first default duration is equal to 3 times the period of the pulse signal;

the second default duration is equal to the period of the pulse signal;

the third default duration is greater than or equal to 4 times the period of the pulse signal;

the fourth default duration is equal to 5 times the period of the pulse signal.

* * * * *